United States Patent [19]

Tanaka

[11] 4,085,575

[45] Apr. 25, 1978

[54] DIGITAL ELECTRONIC TIMEPIECE

[75] Inventor: Kojiro Tanaka, Tokyo, Japan

[73] Assignee: Kabushiki Kaisha Daini Seikosha, Japan

[21] Appl. No.: 725,329

[22] Filed: Sep. 21, 1976

[30] Foreign Application Priority Data

Sep. 22, 1975 Japan ..... 50-114540

[51] Int. Cl.[2] ..... G04B 19/24; G04B 19/34; G04C 3/00

[52] U.S. Cl. ..... 58/4 A; 58/23 R; 58/50 R; 58/58; 58/153

[58] Field of Search ..... 58/4 A, 23 R, 50 R, 58/58, 153

[56] References Cited

U.S. PATENT DOCUMENTS

| | | | |
|---|---|---|---|
| 3,796,037 | 3/1974 | Fujita | 58/4 A |
| 3,852,950 | 12/1974 | Yoda et al. | 58/4 A |
| 3,962,858 | 6/1976 | Levine et al. | 58/4 A |
| 3,971,012 | 7/1976 | Morokawa et al. | 58/50 R X |
| 3,978,296 | 8/1976 | Moriya et al. | 58/4 A X |

*Primary Examiner*—Stanley J. Witkowski

*Attorney, Agent, or Firm*—Robert E. Burns; Emmanuel J. Lobato; Bruce L. Adams

[57] ABSTRACT

A digital electronic timepiece has numeric display means for selectively displaying the time and a number representing the day of the week. In one position of a display selection switch, the display means displays hours and minutes. In another position of the display selection switch, the date and a number representing the day of the week are displayed by the same display elements as those displaying time. Display indicators controlled by the display selection switch indicate what is displayed by the display means.

3 Claims, 3 Drawing Figures

DIGITAL ELECTRONIC TIMEPIECE

FIELD OF INVENTION

This invention relates to a digital electronic timepiece having the function of displaying the time and the day of the week.

BACKGROUND OF THE INVENTION

Conventionally, electronic timepieces displaying the time and the day of the week have been proposed.

However the day of the week is displayed conceptually with "S.M.T.W.T.F.S".

The display element requires an increased number of segments and is difficult in its arrangement if the day of the week having such a letter is to be displayed with a single display element.

And also, the letter-shape is bad in configuration and the electronic circuit driving the respective segments is complicated in circuit structure.

Therefore, conventionally, a plurality of display elements corresponding to the respective letters representing the day of the week are disposed on the display and the day of the week is displayed by driving the respective display element.

In case that the day of the week is displayed with a plurality of display elements, the design is difficult since the respective display elements are disposed on the display panel of limited area together with the display displaying the time.

And further, it is difficult to read the day of the week since the displayed letter is small.

The above display is disadvantageous since different kinds of display elements are needed by reason of lingustic differences.

SUMMARY OF THE INVENTION

It is the object of the invention to provide a digital electronictimepiece displaying the day of the week with figures without displaying it with the conceptual letters.

And also, it is the object of the invention to provide a digital electronic timepiece eliminating the above disadvantage and employing a simplified electronic circuit and display for the day of the week, being simple in structure and low cost in production.

DESCRIPTION OF PREFERRED EMBODIMENT

Figure 1:
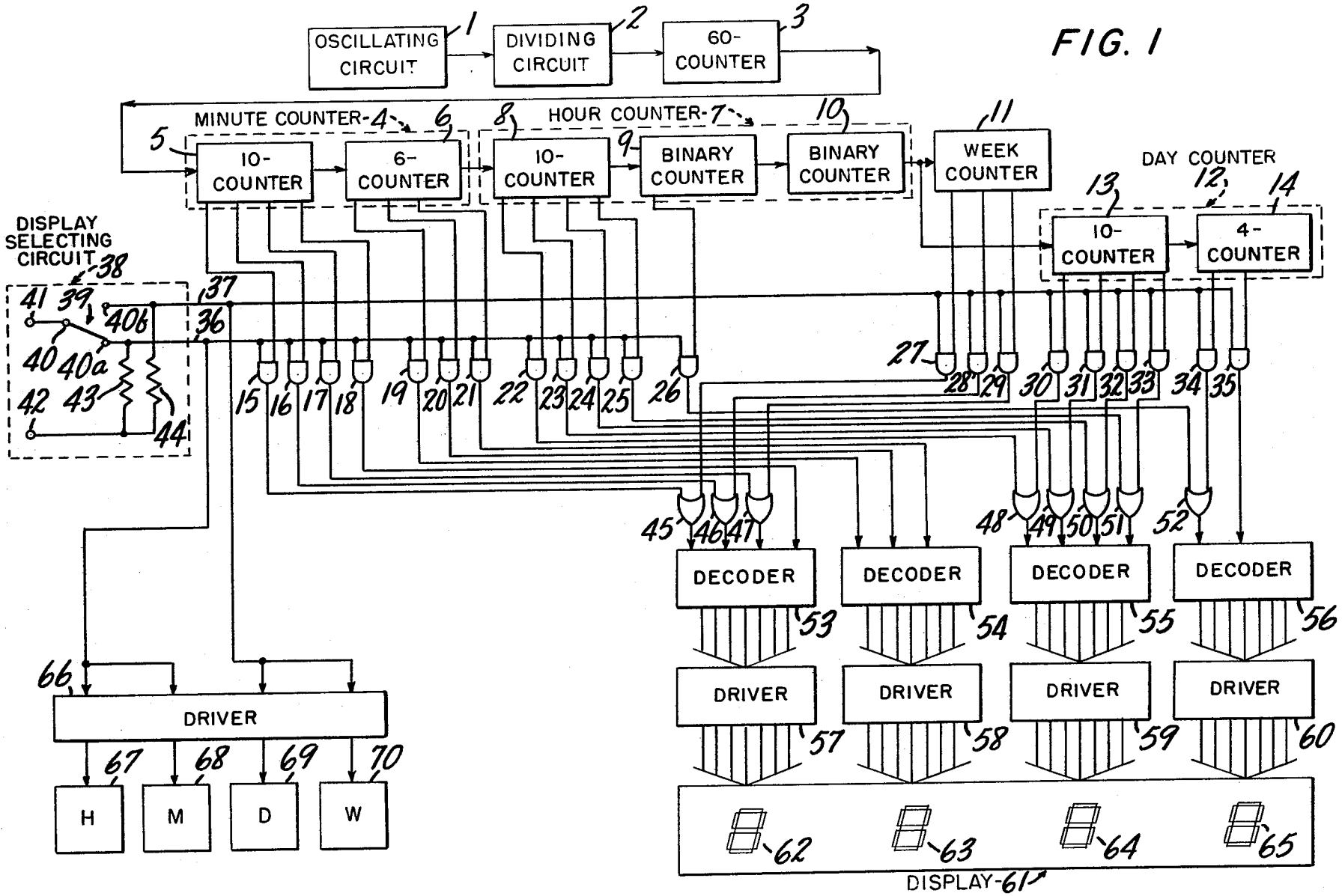
FIG. 1 is a circuit diagram showing an embodiment of the digital electronic timepiece according to this invention.

Referring now to the embodiment according to this invention, FIG. 1 is a circuit diagram showing one embodiment of the digital electronic timepiece according to this invention.

Reference numeral 1 is the oscillating circuit employing a crystal vibrator such as a quartz crystal.

The oscillating circuit 1 produces a signal of 32,726Hz and the oscillating output signal is applied to the dividing circuit 2 having a plurality of dividing stages so that the frequency of 1Hz is produced.

This 1Hz-signal, namely 1 second pulse is applied to the 60-counter 3.

And the 60-counter 3 produces a 60 seconds pulse namely a 1 minute pulse.

This 1-minute pulse is applied to the minute-counter 4 including a 10-counter 5 and 6-counter 6.

The output signal of the minute counter 4, namely a 1 hour pulse is applied to the hour counter 7 which is a 24-counter including a 12-counter comprising the 10-counter 8 and the binary counter 9, and the binary counter 10.

The output signal of the hour counter, namely the 1 day pulse which is the output signal of the binary counter 10, is applied to the week counter 11 being a 7-counter, and is also applied to the day counter 12 being a 31-counter including the 10-counter 13 and the 14.

The 10-counter 5 of the minute counter 4 consists of a 4 bits binary counter and the BCD code-output of the 4 bits binary counter is applied to the AND circuits 15, 16, 17, 18 respectively.

The 6-counter 6 comprises a 3 bits binary counter, and its BCD code-output is applied to the AND circuits 19, 20, 21 respectively.

The 10-counter 8 of the hour counter 7 comprises a 4 bits binary counter and its BCD code-output is applied to the AND circuits 22, 23, 24, 25 respectively and also the binary counter 9 comprises a 1 bit binary counter of which the output signal is applied to the AND circuit 26.

The week counter 11 comprises a 3 bits binary counter of which the BCD code output is applied to the AND circuits 27, 28, and 29 respectively.

The 10-counter 13 of the day counter 12 comprises a 4 bits binary counter of which the BCD code output is applied to the AND circuits 30, 31, 32 and 33 respectively.

And further, the 4-counter 14 of the day counter 12 comprises a 2 bits binary counter of which the BCD code output is applied to the AND circuits 34, 35.

One input terminal of each of the AND circuits 15 – 26 receives the output signal of the display selecting circuit 38 through the line 36.

And also one input terminal of each the AND circuits 27 – 35 receives the output signal of the display selecting circuit 38 through line 37.

The display selecting circuit 38 has a manual change over switch 39 which includes the movable contact 40 connected to the high level voltage supplying terminal 41 having the logical level "1" and fixed contacts **40*a*, 40*b* connected to the low level voltage supplying terminal 42 having the logical level "0" through the resistors 43, 44**.

The output signal of this display selecting circuit 38 is produced from the fixed contacts **40*a* and 40*b* of the change-over switch 39**.

The fixed contact **40*a* is connected to line 36 and the fixed contact 40*b* is connected to line 37**.

The respective output signals of the AND circuits 15, 16, 17 are applied to the other terminals of OR circuit 45, 46, 47 receiving the respective output signals of the AND circuits 27, 28, 29.

The respective output signals of the AND circuits 22, 23, 24, 25 are applied to OR circuits 48, 49, 50, 51 receiving the respective output signals of the AND circuit 30, 31, 32, 33.

And the output signal of the AND circuit 26 is applied to OR circuit 52 receiving the output signal of the AND circuit 34.

The output signals of the OR circuits 45 - 47 and the AND circuit 18 are applied to the decoder 53 for coverting the BCD code to a segment signal of 7 segment and the output signals of the AND circuits 19 - 21 are applied to another decoder 54.

The ouput signals of the OR circuits 48 - 51 are applied to another decoder 55 and further the output signals of the OR circuit 52 and the AND circuit 35 are applied to another decoder 56.

The output signals of the decoders 53 - 56 are fed to the display 61 through the drivers 57, 58, 59, 60.

The display 61 comprises four display elements 62, 63, 64, 65 each of which has seven segments arranged in "8" shape.

There are also provided a display 67 indicating "H" meaning the hour, a display 68 indicating "M" meaning the minute, a display 69 indicating "D" meaning the date and a display 90 indicating "W" meaning the day of week.

The displays 67, 68, 69 and 70 are drived selectively by the output signal of the display selecting circuit 38 through a driver 66.

The operation of the digital electronic timepiece having the above mentioned circuit construction will now be described.

One input terminal of each of the AND circuits 15 - 26 is maintained in the state of logical level "1" through the line 36 when the movable contact 40 of the change over switch 39 in the display selecting circuit 38 connects to the fixed contact **40*a* as shown in FIG. 1**.

Also since one input terminal of each of the AND circuits 27 - 35 is maintained in the state of the logical level "0", the respective counted contents of the minute counter 4 and the hour counter 7 are applied to the decoders 53 - 56 through the AND circuits 15 - 26 and the OR circuits 45 - 52, or are applied to the decoders 53 - 56 directly.

Accordingly, the minutes are displayed by the display elements 62, 63 of the display 61 and the hour is displayed by the display elements 64, 65.

At the same time, the displays 67, 68 are driven by the driver 66 to display "H" and "M" respectively.

The line 36 comes to be at logical level "0" when the movable contact 40 of the change over switch 39 in the display selecting circuit 38 connects to the fixed contact **40*b***.

Accordingly, the line 37 comes to be in the state of logical level "1" whereby the counted contents of the week counter 11 and the day counter 12 are applied to the decoders 53 - 56 through the AND circuits 27 - 35 and the OR circuits 45 - 52, or are applied to the decoders 53 - 56 directly.

Accordingly, the day of the week is displayed as a number by the display element 62 of the display 61.

The unit date and tens date are displayed by the display elements 64 and 65 respectively.

At the same time, the displays 69 and 70 are driven by the driver 66 to display "D" and "W" respectively.

The day of the week is displayed as a number by the display element 62 it being assumed that "1" is Sunday, "2" is Monday, "3" is Tuesday, "4" is Wednesday, "5" is Thursday, "6" is Friday, and "7" is Saturday.

Figure 2:
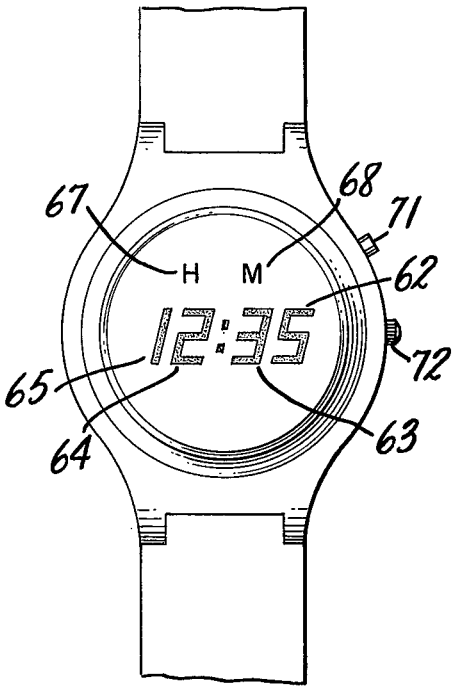
FIG. 2 is a plan view showing one example of displaying the time in the digital electronic timepiece as shown in FIG. 1.

FIG. 2 shows an example of displaying the time with the digital electronic timepiece according to this invention.

The time 12:25 is displayed and the letters of "H" and "M" are displayed.

Figure 3:
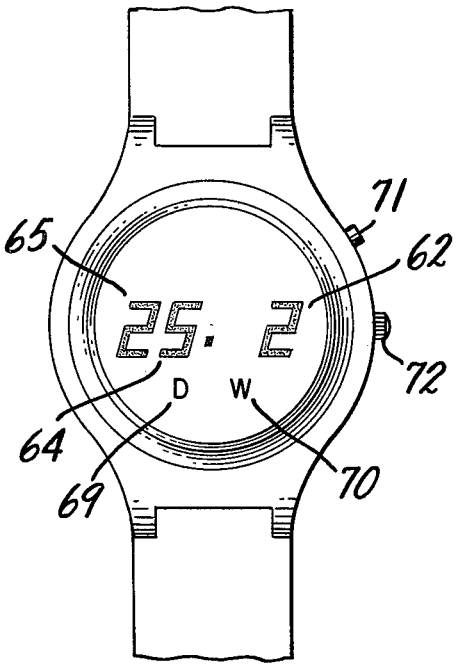
FIG. 3 is a plan view showing another example of displaying the week and the date in the digital electronic timepiece.

FIG. 3 shows another example of display by the time with the digital electronic timepiece according to present invention when the date and the day of week are displayed.

FIG. 3 shows the date of 25 and 2 representing Monday and the letters of "D" and "W" are displayed.

In FIG. 2 and FIG. 3, the reference numeral 71 designates the operating button to actuate the change over switch 39 in FIG. 1, the reference numeral 72 designates the winding stem.

The winding stem 72 operates a mechanical switch not shown in FIG. 1 whereby it controls the operation of the adjusting circuit for correcting the time, the date and the day of the week.

In FIG. 2 and FIG. 3, the same member as that of FIG. 1 is designated by the same reference numeral.

A digital electronic timepiece according to this invention has been explained in the detail by reference to the embodiment shown in the drawing.

There will be obvious to those skilled in the art many modifications and variations of the above described structure.

The digital electronic timepiece according to this invention is able to display all of the days week with a single display element.

And also, the digital electronic timepiece according to this invention is able to have simplified circuit construction of the display and is able to avoid the problems of the arrangement of the display element and of small letters.

And further, the digital electronic timepiece according to this invention is able to be simple in the electronic circuit relating to the display and to be simple in low cost.

And still further, the digital electronic timepiece is able to use a simplified circuit in the display since either the time or the day of the week is displayed selectively with one display.

And still further, the digital electronic timepiece can be used worldwide since the displayed figure representing the day of the week is common throughout the world.

I claim:

1. A digital electronic timepiece displaying the time and the day of the week, comprising a numeric display means for selectively displaying only numbers, said display means comprising a plurality of display elements each of which comprises means for selectively displaying a digit, display selecting means controlling said display means to display the time and alternatively to display a number representing a day of the week, said number representing a day of the week being selectively displayed by one of the same display elements as used for displaying time, and means coordinated with said display selecting means to indicate whether time or day of the week is displayed.

2. A digital electronic timepiece according to claim 1, in which said display means comprises four display elements for displaying hours and minutes in one condition of said display selecting means and for displaying the date and a number representing the day of the week in another condition of said display selecting means.

3. A digital electronic timepiece according to claim 2, in which said indicating means comprises means apart from said numeric display means and controlled by said display selecting means for displaying indicia indentifying what is displayed by said numeric display means.

* * * * *